US005095929A

United States Patent [19]

Harvey

[11] Patent Number: 5,095,929

[45] Date of Patent: Mar. 17, 1992

[54] RAIL TANK CAR CLEANING SYSTEM

[75] Inventor: Charles D. Harvey, Houston, Tex.

[73] Assignee: Weatherford U.S., Inc., Houston, Tex.

[21] Appl. No.: 633,605

[22] Filed: Dec. 20, 1990

Related U.S. Application Data

[63] Continuation-in-part of Ser. No. 575,125, Aug. 30, 1990.

[51] Int. Cl.[5] ..... B08B 3/02; B08B 9/08

[52] U.S. Cl. ..... 134/167.00 R; 239/227

[58] Field of Search ..... 134/167 R, 168 R, 172, 134/177, 180, 181; 118/306, 317; 239/227, 587

[56] References Cited

U.S. PATENT DOCUMENTS

| | | | |
|---|---|---|---|
| 3,741,808 | 6/1973 | Stalker | 134/167 R X |
| 3,896,756 | 7/1975 | Jaeger | 134/167 R X |
| 3,961,983 | 6/1976 | Crandall et al. | 134/168 R X |
| 4,163,546 | 8/1979 | Morris et al. | 239/227 X |
| 4,244,523 | 1/1981 | Looper | 134/167 R X |
| 4,574,825 | 3/1986 | Haug | 134/167 R |
| 4,805,650 | 2/1989 | Yasui et al. | 134/167 R X |

FOREIGN PATENT DOCUMENTS

| | | | |
|---|---|---|---|
| 2409759 | 9/1975 | Fed. Rep. of Germany | 134/167 R |

*Primary Examiner*—Philip R. Coe

*Attorney, Agent, or Firm*—Jones, Day, Reavis & Pogue

[57] ABSTRACT

Tank car cleaning apparatus mountable on a tank car hatch and movable within the car to clean its interior, the apparatus including a rotatable mast with a movable arm connected thereto having a high pressure liquid nozzle mounted at its end for applying liquid under pressure to the car's interior to clean it, the arm movable from outside the car into its interior, and in one aspect, the nozzle itself articulable through an arc.

21 Claims, 3 Drawing Sheets

RAIL TANK CAR CLEANING SYSTEM

CROSS REFERENCE TO RELATED APPLICATION

This is a Continuation-In-Part of U.S. application Ser. No. 07/575,125 filed on Aug. 30, 1990 entitled "Rail Tank Car Cleaning System."

BACKGROUND OF THE INVENTION

1. Field of the Invention

This invention is directed to rail tank car cleaning systems and, in one aspect, to such systems which can be operated without personnel inside a tank car.

2. Background of the Invention

Periodically, rail tank cars need to be cleaned. These cars are used to transport a wide variety of materials and often, before one material can be introduced into a car, residues and remainders of a previously-transported material must be removed. Water jetting systems producing a stream of high pressure water have been used to clean tank car interiors. Some of these systems have in the past been used by personnel inside of the cars. This can be extremely dangerous for these personnel. Injuries and fatalities in these situations are not uncommon.

Adequate cleaning of a tank car often requires that substantially all of a previously-transported material be removed. The present inventor is unaware of any available prior art system which can accomplish such cleaning without personnel present inside the car. A system is known in the prior art which uses an arm movably mounted on a mast which can move in an arc into a tank car. A nozzle is immovably mounted on the movable arm and hoses run to the nozzle to supply fluid under pressure. The arm is moved by a series of driven pinch rollers which move the arm by frictional contact. The mast is movable about a pedestal receivable in an opening of a tank car. Counterbalancing weights are provided. This system has been used without personnel present in a car, but it has not proven adequate to clean the entire interior of a car.

There has long been a need for an effective rail tank car cleaning system. There has long been a need for such a system which has an arm which is positively driven with little or no slippage. There has long been a need for such a system which does not require the presence of operator personnel within the car during the cleaning operation. There has long been a need for such systems which can clean substantially all of the interior of a tank car.

SUMMARY OF THE PRESENT INVENTION

The present invention, in one embodiment, is directed to a rail tank car cleaning apparatus which has a mainframe mast to which is pivotably connected a guide arm having a high pressure nozzle mounted at its end. Water (or other fluids) and air supply hoses extend from the mast, along the guide arm, to the nozzle and in one embodiment, to an air-activated cylinder adjacent the nozzle which operates to adjust the position of the nozzle. The mast is secured to a mounting pedestal that fits in a tank car's top opening. In one embodiment, a pedestal adapter is provided for use with openings of different sizes. A motor preferably pneumatic and preferably on the mast provides power for moving the mast about an upright support, thus providing for movement of the nozzle within the car. The motor also provides power for raising and lowering the guide arm within the car to effect a change in position of the nozzle. In one embodiment, this is accomplished by a driven sprocket acting on a chain extending along the length of the guide arm. For balance, a counterweight is employed on the mast. A control panel on the mast is interconnected with the motor for easy operation. A pivotable mounting of the nozzle to the guide arm and the use of an air cylinder movably interconnected between the nozzle and the guide arm provides further articulation and movement for the nozzle.

In one embodiment, the nozzle mounted at the end of the guide tube is moved and controlled by a cable connected to the nozzle and extending to a point outside the tank to be cleaned. Both this cable and a hose supplying fluid to the nozzle can extend within and be enclosed by a hollow guide tube. The cable may exit the guide tube and be attached to an air cylinder on the mast (or on a guide arm) which moves the cable to, in turn, move a beam to which is connected the nozzle.

It is, therefore, an object of the present invention to provide new, unique, effective, safe and nonobvious rail tank car cleaning systems.

Another object of the present invention is the provision of such a system which can provide fluid under pressure to substantially all of the interior of a tank car.

Yet another object of the present invention is the provision of such a system which can be operated from outside of a tank car without personnel inside the car during the operation.

A further object of the present invention is the provision of such systems which are adaptable to a variety of types of tank cars.

An additional object of the present invention is the provision of such systems which are power operated.

Another object of the present invention is the provision of such a system with a nozzle on a movable arm, the nozzle itself movable with respect to the arm.

Yet another object of the present invention is the provision of such a system in which the movable arm is positively driven.

A further object of the present invention is the provision of a tank car cleaner in which a nozzle supply hose, a nozzle control cable, or both extend from the nozzle and are partially enclosed by a hollow guide tube, the cable extending to a cable mover, e.g., an air cylinder, exteriorly of the tank to be cleaned.

The present invention recognizes and addresses the previously-mentioned long-felt needs and provides a satisfactory meeting of those needs. To one of skill in this art who has the benefits of this invention's teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to ensure adequacy and aid understanding, this is not intended to prejudice that purpose of a patent which is to claim an invention no matter how others may later disguise it by variations in form or additions or further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by reference to certain embodiments thereof which are illustrated in the appended drawings, which drawings form a part of this specification. It is to be noted, however, that the appended drawings illustrate preferred embodiments of the invention and are therefore not to be considered limiting of its scope, for the invention may admit to other equally effective equivalent embodiments.

DESCRIPTION OF EMBODIMENTS PREFERRED AT THE TIME OF FILING FOR THIS PATENT

Figure 1:
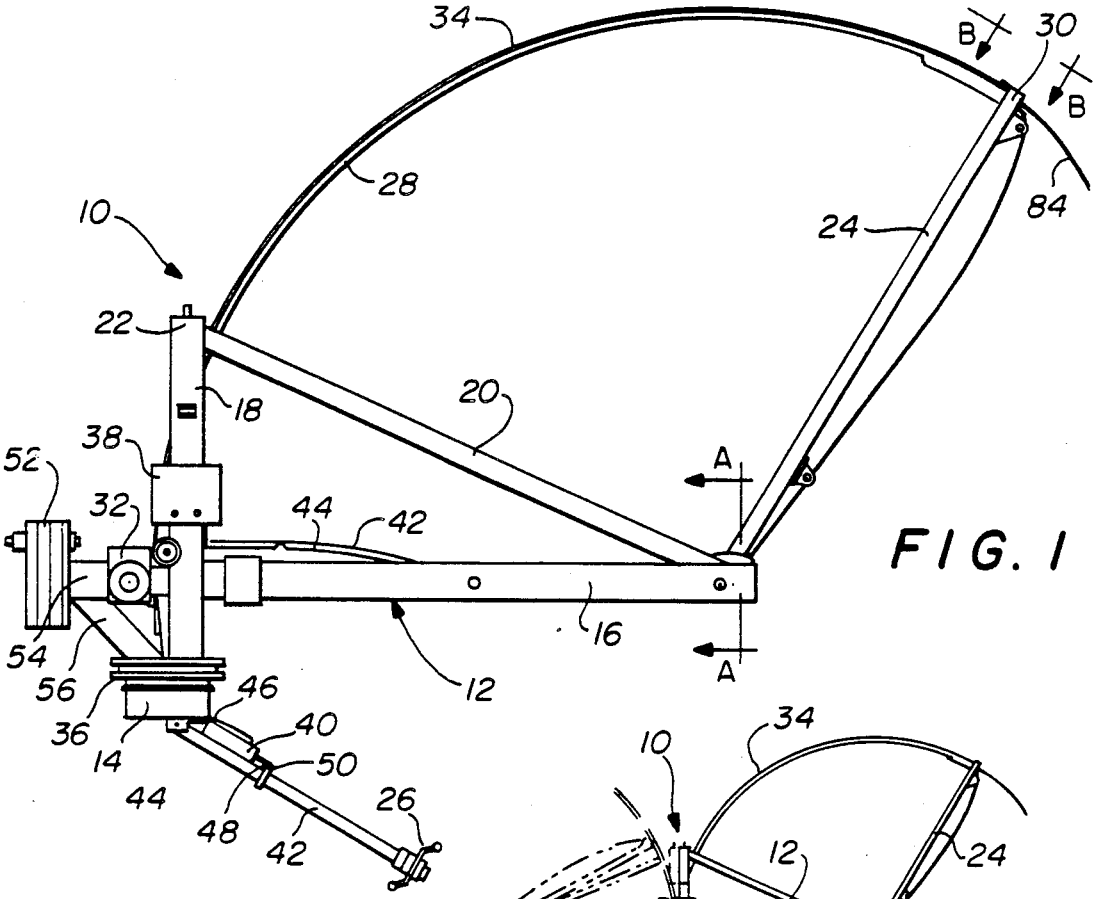
FIG. 1 is a front schematic view of a tank car cleaning system according to the present invention.

Referring now to FIG. 1, a system 10 according to the present invention has a mainframe 12 rotatably mounted on a pedestal 14. The mainframe 12 includes a mast 16 secured to an upright member 18 and a crossbeam 20 secured between the mast 16 and an end 22 of the upright member 18.

A guide arm 24 is pivotably connected to the crossbeam 20 and the mast 16 for adjusting the position of a nozzle 26 secured to a tube guide 28 which itself is secured to an upper end 30 of the guide arm 24.

The tube guide, guide arm, and nozzle are moved by the power of a motor 32 mounted on the mast 16. The motor 32 drives a sprocket via a gear box (not shown) which meshes with links of a chain 34 that extends along the tube guide 28. As the sprocket rotates and acts on the chain 34, the chain 34 and hence the tube guide 28 are moved with positive control up or down depending on which way the motor is moving. In turn, this raises or lowers the end of the tube guide to which is mounted the nozzle 26.

Rotative movement of the mainframe 12 with respect to the pedestal 14 is made possible by a bearing 36 with multiple roller balls on which is mounted the pedestal 14. The mainframe 12 is rotated by hand about its vertical axis. A control panel 38 is interconnected between a pressurized air source 47 and its conduit 45 and hoses 42 and 44 which convey air under pressure to the motor 32 and to an air cylinder 40. An operator can stand adjacent the control panel and control the movement of the mainframe 12 and of the nozzle 26 with the controls of the control panel 38.

Fluid under pressure (e.g. water) is conveyed to the nozzle 26 through a hose 84 which extends along the tube guide 28 and to the nozzle 26. The other end of the hose 84 is connected to a source of pressurized fluid 81.

The nozzle 26 is secured to a nozzle beam or arm 41 which itself is pivotably connected to an end 43 of the tube guide 28. The air cylinder 40 has one end 46 connected to tube guide or to the pedestal 14 and offset from a point of connection of the nozzle arm 42 to the tube guide 28. Another end 48 of the air cylinder 40 is secured with a clevis 50 to the nozzle arm 42. Release of the air cylinder causes an internal piston (not shown) to extend, lowering the nozzle arm 42. Activation of air acting on the piston allows the piston to retract causing the nozzle arm 42 to be raised. In one preferred embodiment this provides a range of motion of at least about 77 degrees—about 60 degrees from the vertical on one side and about 17 degrees from the vertical on the other.

A counterweight 52 mounted on an end 54 of the mast 16 balances the weight of the guide arm 24 and other members. A support 56 extends from the end 54 of the mast 16 to the bearing 36.

Figure 2:
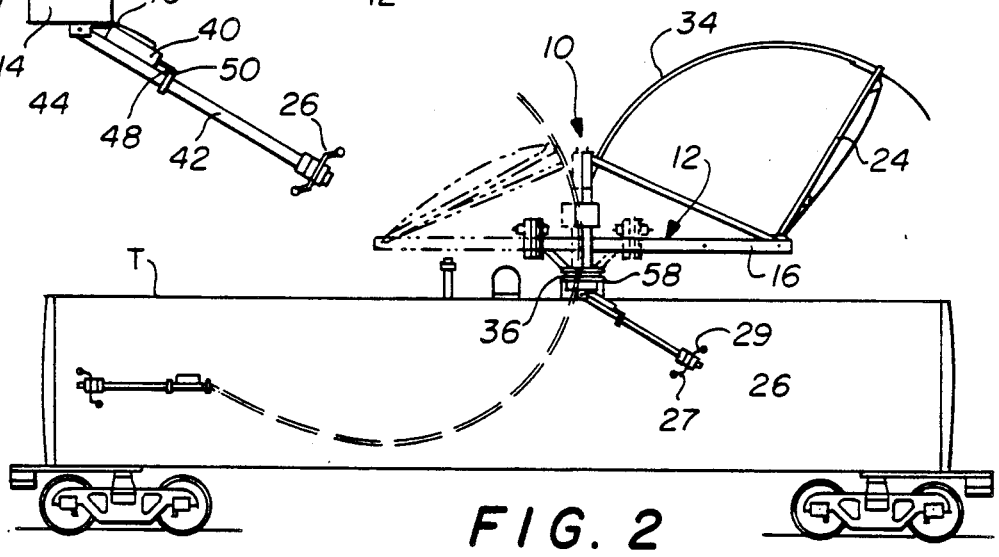
FIG. 2 is a front view of a system as shown in FIG. 1 disposed on a tank car.

As shown in FIG. 2, the system 10 is installed on a tank car T with the pedestal 14 positioned in a hatch 58 of the car T. The system 10 is movable to other positions such as that shown in dotted lines in FIG. 2. Two types of movement are represented. The mainframe 12 has moved 180° (from right to left in the drawing) rotating on the bearing 36; and the guide arm 24 has rotated about its connection to the mast 16 and crossbeam 20 to move within the car T. The mainframe 12 can move through a complete circle around the opening in the hatch 58. Movement of the nozzle 26 with respect to the tube guide 28 provides a third mode of movement—all of which contribute to the ability of the system 10 to access substantially the entire interior of the car T with high pressure water (or other fluid). The nozzle 26 preferably has rotating, dual opposed spray nozzles 27 and 29.

Figure 3:
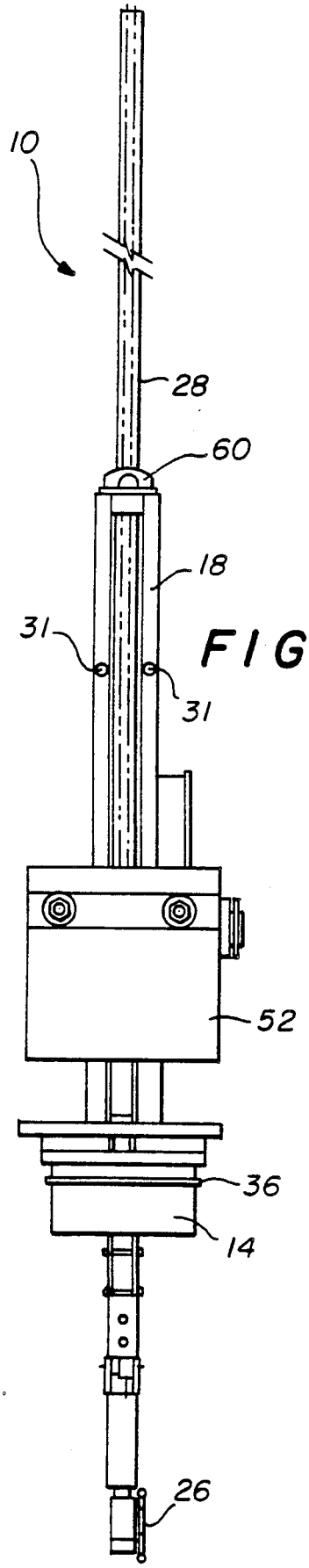
FIG. 3 is a side view of the system of FIG. 1.

FIG. 3 shows a rear view of the system 10 of FIG. 1. An eye 60 on the upright member 18 provides a connection point for a hook connected, e.g. to a crane, for lifting the system 10. Rollers 18 rotatably secured to the mast facilitate the movement of the tubing guide.

Figure 4:
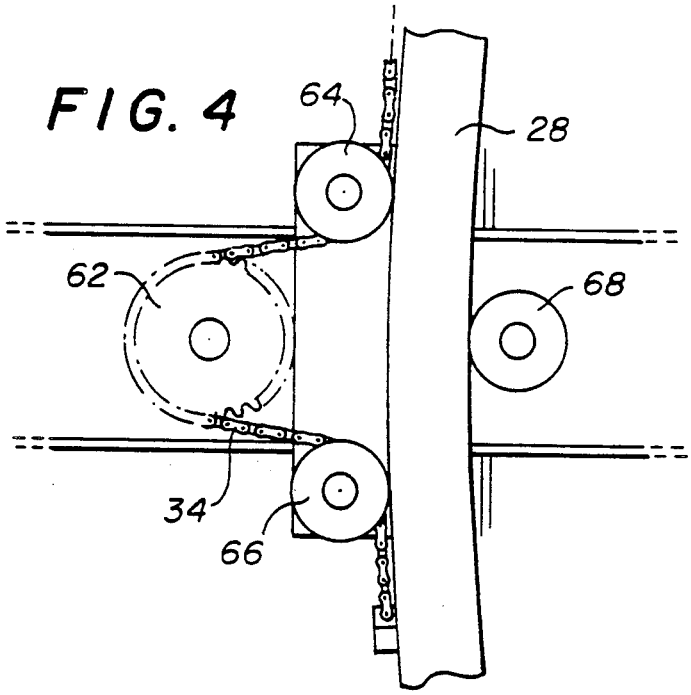
FIG. 4 is a detailed view of the chain and drive gears of the system of FIG. 1.

The detail drawing of FIG. 4 shows the driving of the chain 34 by a sprocket 62 interconnected to gear box which is interconnected with a shaft (not shown) of the motor 32. Rotatable idler gears 64, 66 mounted to the mast maintain the chain 34 about the gear 62. A roller 68 maintains the tube guide 28 in position and facilitates its movement.

Figure 5:
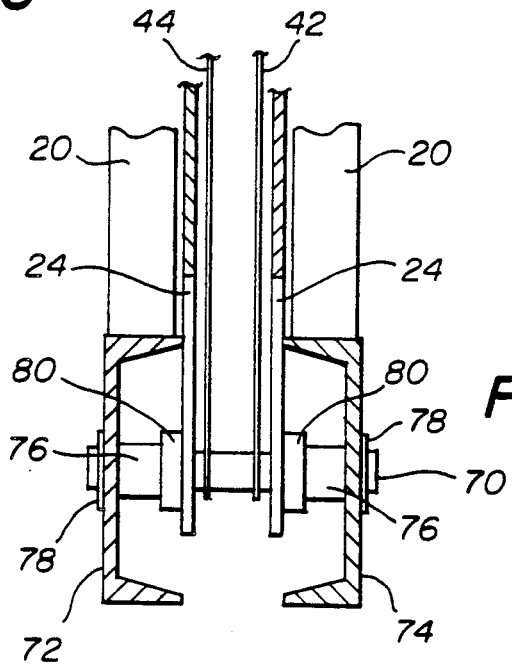
FIG. 5 is a view along line A—A of FIG. 1.

The movable connection of the guide arm 24 to the mast 16 is shown in FIG. 5. The guide arm 24 is movably mounted on a shaft 70 which extends from one side 72 of the mast 16 to another side 74 of it. Spacers 76 maintain the position of the guide arm 24 on the shaft 70 and retainer rings 78 maintain the shaft 70 in position through the mast 16. Bearings 80 facilitate rotation of the guide arm 24 about the shaft 70. Hoses 42 provide air under pressure to the air cylinder 40.

Figure 6:
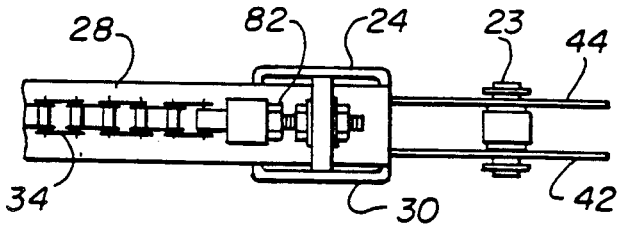
FIG. 6 is a view along line B—B of FIG. 1.

FIG. 6 illustrates the chain 34 extending along the tube guide 28 and a connection mechanism 82 for securing and tightening the chain. The mechanism 82 is secured to the top 30 of the guide arm 24. Hoses 42, 44, 84 extend over a guide bar 12 which supports them. Hose 84 is a high pressure hose; e.g. a ¾" hose extending to the nozzle 26 and through which fluid under pressure for cleaning a tank car interior is conveyed. Hose 42 provides air under pressure to extend the air cylinder 40 and hose 44 provides air under pressure to retract the air cylinder 40. Another hose (not shown) can be provided to transmit air under pressure to an air-operated nozzle.

Figure 7:
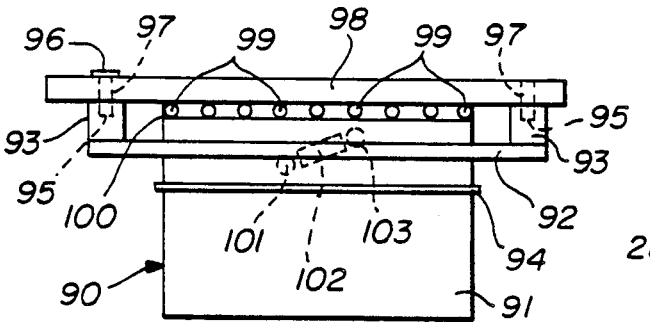
FIG. 7 is a side view of a car opening adapter according to the present invention.
Figure 8:
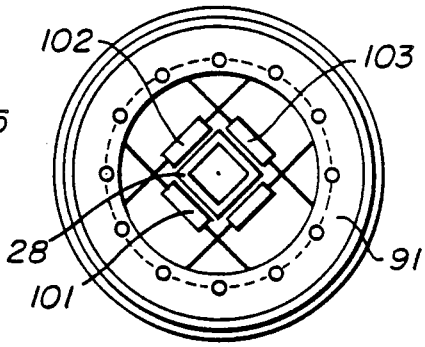
FIG. 8 is a bottom view of the adapter of FIG. 7.

FIGS. 7 and 8 illustrates an opening adapter 90 which can be applied to an opening of a tank car so that a system according to the present invention with a pedestal of a diameter larger than the opening may be used to clean the tank car. The adapter 90 has a main body 91 and an upper plate 92. Arms 93 secured to the plate 92 have openings 95 therein into which a pin 96 can be inserted through a hole 97 in a pedestal plate 98 to prevent the pedestal from moving. When the pin is removed the pedestal plate 98 (and attached pedestal, etc.) are free to move on ball bearings 99 in bearing mount 100 which is secured to the top of the body 91. Rollers 101, 102, 103 are rotatably mounted to the interior of the body 91 to facilitate movement of the tube guide therethrough. The ring 94 is sized to prevent the adapter 90 from going further into a car opening.

One embodiment of a system according to the present invention is designed for tank cars with 98 to 112 inches I.D. and overall lengths up over 40 feet. it is mounted to the opening shroud of a tank car, and can be adapted to either an 18 or 20 inch diameter opening. The nozzle arm moves the cleaning head up or down so it stays positioned at the tank center line. high pressure water, supplied from a water blaster unit, is conveyed to the cleaning head through a ¾ inch 10,000 p.s.i. rated hose mounted in the guide arm and nozzle arm. This embodiment is capable of operating with flow rates up to 80 gallons per minute and pressures up to 10,000 p.s.i.

Figure 9:
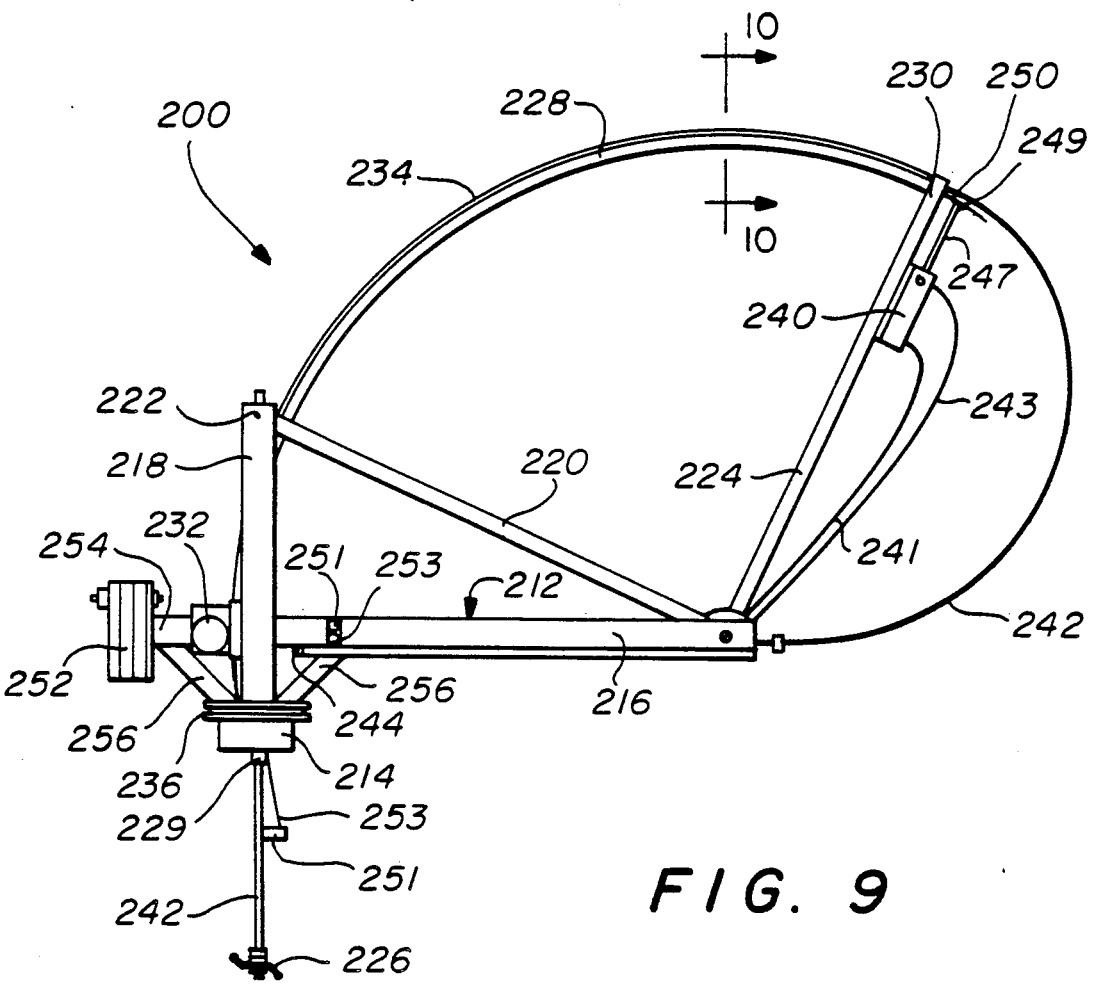
FIG. 9 is a front schematic view of a tank car cleaning system according to the present invention.
Figure 10:
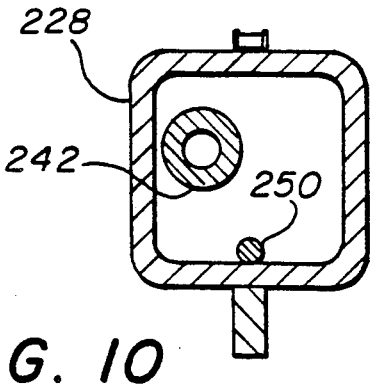
FIG. 10 is a cross-sectional view along line 10—10 of FIG. 9.

Referring now to FIG. 9, a system 200 according to the present invention has a mainframe 212 rotatably mounted on a pedestal 214. The mainframe 212 includes a mast 216 secured to an upright member 218, crossbeam 220 secured between the mast 216 and an end 222 of the upright member 218, and a guide arm 224 pivotably connected to the mast 216 for adjusting the position of a nozzle 226 secured to a hollow tube guide 228 which itself is secured to an upper end 230 of the guide arm 224.

The tube guide, guide arm, and nozzle are moved by the power of a motor 232 mounted on the mast 216. The motor 232 drives a sprocket via a gear box (not shown) which meshes with links of a chain 234 that extends along the tube guide 228. As the sprocket rotates and acts on the chain 234, the chain 234 and hence the tube guide 228 are moved with positive control up or down depending on which way the motor is moving. In turn, this raises or lowers the end of the tube guide to which is mounted the nozzle 226.

The mainframe 212 is mounted and rotated like the frame 12, FIG. 1. A hose 242 conveys fluids (e.g. water) under pressure to the nozzle 226. The hose 242 extends on the mast 216 to a hose connection 244 which itself intercommunicates with a high pressure fluid source (not shown). Air under pressure is conveyed to an air cylinder 240 secured to the guide arm 224 by hoses 241 and 243 which extend to connections 257 and 253 on the mast 216. These connections in turn intercommunicate with a pressurized air source (not shown). Some or all of the hoses as well as the motor may be controlled from a remote control panel (not shown) interconnected with them.

The nozzle 226 is secured to a nozzle beam or arm 242 which itself is pivotably connected to an end of the tube guide 228 at 229. A piston 247 of the air cylinder has an end 249 of a cable 250 attached thereto. The other end 253 of the cable 250 is attached to an arm 251. Movement of the piston 247 moves the cable 250, in turn moving the arm 242 and the nozzle 226. Activation of the air cylinder causes the piston to retract. Release of air acting on the piston allows the piston to extend. In one preferred embodiment this provides a range of motion for the nozzle of at least about 95 degrees—about 60 degrees from the vertical on one side and about 35 degrees from the vertical on the other.

A counterweight 252 mounted on an end 254 of the mast 216 balances the weight of the guide arm 224 and other members. Supports 256 extend from the mast 216 to the pedestal 214 and its support.

In conclusion, therefore, it is seen that the present invention and the embodiments disclosed herein are well adapted to carry out the objectives and obtain the ends set forth at the outset. Certain changes can be made in the method and apparatus without departing from the spirit and the scope of this invention. It is realized that changes are possible and it is further intended that each element or step recited in any of the following claims is to be understood as referring to all equivalent elements or steps for accomplishing substantially the same results in substantially the same or equivalent manner. It is intended to cover the invention broadly in whatever form its principles may be utilized. The present invention is, therefore, well adapted to carry out the objects and obtain the ends and advantages mentioned, as well as others inherent therein.

What is claimed is:

1. An apparatus for cleaning an interior of a tank car, the apparatus comprising a mast having a first end and a second end, an arcuate tube guide having a first end and a second end, the first end rotatably connected to the second end of the mast, moving means for moving the tube guide, the moving means mounted to the mast, the tube guide movable positively by the moving means, at least one spray nozzle mounted to a beam, the beam articulably mounted to the second end of the tube guide, the spray nozzle for spraying fluid under pressure on the tank car interior, articulating means for controlling the arc of the beam relative to the second end of the tube guide, the tube guide movable toward and away from the mast so that upon emplacement of the apparatus on an opening in the tank car a portion of the tube guide is movable into and out of the tank car, including the second end of the tube guide and the nozzle, and nozzle hose means for conveying fluid to be sprayed to the spray nozzle, the nozzle hose means extendable from the spray nozzle exteriorly of the tank car.

2. The apparatus of claim 1 wherein the nozzle hose means extends along and is supported by the tubeguide.

3. The apparatus of claim 1 wherein the apparatus is rotatably emplaceable on the tank car opening.

4. The apparatus of claim 1 comprising also an air cylinder with an extendable piston secured at one end to the tube guide and at the other to the beam so that movement of the air cylinder piston articulates the beam and the spray nozzle, and cylinder hose means for conveying air under pressure to the air cylinder, the cylinder hose means extending from the cylinder exteriorly of the tank car.

5. The apparatus of claim 4 wherein the spray nozzle can be articulated through an arc of at least about 77 degrees.

6. The apparatus of claim 4 wherein the cylinder hose means extends along and is supported by the tube guide.

7. The apparatus of claim 1 wherein an air cylinder with a movable piston is secured to the mast and a control cable is secured to the piston and to the beam so that movement of the piston moves the cable thereby moving the beam and the nozzle.

8. The apparatus of claim 7 wherein the nozzle is articulable through an arc of at least about 95 degrees.

9. The apparatus of claim 7 wherein the tube guide is hollow and a major part of the cable is within the tube guide.

10. The apparatus of claim 9 wherein the tube guide is hollow and a major part of the nozzle hose means is within the tube guide.

11. The apparatus of claim 1 wherein the mast is mounted on a pedestal which is emplaceable in the tank car opening.

12. The apparatus of claim 11 wherein the pedestal has a bearing member on which the mast is rotatably mounted.

13. The apparatus of claim 11 including also mast moving means interconnected with the mast for moving it on the bearing member.

14. The apparatus of claim 11 wherein the pedestal has a stop member for preventing further downward movement of the pedestal into the tank car opening upon contact of the tank car by the stop member.

15. The apparatus of claim 11 wherein roller means are provided in the pedestal for facilitating movement therethrough of the tube guide, the tube guide contacting the roller means.

16. The apparatus of claim 1 wherein a chain is disposed on the tube guide and is positively drivable by a sprocket interconnected with and driven by the moving means.

17. An apparatus for cleaning an interior of a tank car, the tank car having a top opening, the apparatus comprising a mast having a first end and a second end, an arcuate tube guide having a first end and a second end, the first end rotatably connected to the second end of the mast, a pedestal having a bearing member, the mast rotatably mounted on the bearing member, the pedestal emplaceable in the tank car top opening, moving means for moving the tube guide, the moving means mounted to the mast, the tube guide movable positively by the moving means, at least one spray nozzle mounted to a beam, the beam articulably mounted to the second end of the tube guide, the spray nozzle for spraying fluid under pressure on the tank car interior, articulating means for controlling the arc of the beam relative to the second end of the tube guide, the tube guide movable toward and away from the mast so that upon emplacement of the apparatus on the top opening in the tank car a portion of the tube guide is movable into and out of the tank car, including the second end of the tube guide and the nozzle, and nozzle hose means for conveying fluid to be sprayed to the spray nozzle, the nozzle hose means extendable from the spray nozzle exteriorly of the tank car.

18. The apparatus of claim 17 wherein the tube guide is hollow and the nozzle articulation means comprises an air cylinder with a movable piston, the cylinder mounted to the mast, a control cable secured to the piston and to the beam, movement of the piston moving the cable and thereby moving the beam and the nozzle, the nozzle hose means and the cable extending partially through the tube guide.

19. An apparatus for cleaning an interior of a tank car, the apparatus comprising a mast having a first end and a second end, an arcuate tube guide having a first end and a second end, the first end rotatably connected to the second end of the mast, moving means for moving the tube guide, the moving means mounted to the mast, the tube guide positively drivable by the moving means, at least one spray nozzle mounted to a beam movably mounted to the second end of the tube guide, the spray nozzle for spraying fluid under pressure on the tank car interior, the beam articulable through an arc of at least about 77 degrees, the tube guide movable toward and away from the mast so that upon emplacement of the apparatus on an opening in the tank car a portion of the tube guide is movable into and out of the tank car, including the second end of the tube guide and the nozzle, and nozzle hose means for conveying fluid to be sprayed to the spray nozzle, the nozzle hose means extendable from the spray nozzle exteriorly of the tank car, the nozzle hose means extending along and supported by the tubeguide, an air cylinder with an extendable piston secured at one end to a portion of a pedestal on which the mast is mounted and at the other to the beam so that movement of the air cylinder piston articulates the spray nozzle, and cylinder hose means for conveying air under pressure to the air cylinder, the cylinder hose means extendable from the cylinder exteriorly of the tank car, the cylinder hose means extending along and supported by the tube guide.

20. An apparatus for cleaning an interior of a tank car, the apparatus comprising a mast having a first end and a second end, pedestal having a bearing member, the mast rotatably mounted on the bearing member, the pedestal emplaceable in the tank car opening, an arcuate tube guide having a first end and a second end, the first end rotatably connected to the second end of the mast, moving means for moving the tube guide, the moving means mounted to the mast, the tube guide positively drivable by the moving means, at least one spray nozzle mounted to a beam movably mounted to the second end of the tube guide, the spray nozzle for spraying fluid under pressure on the tank car interior, the tube guide movable toward and away from the mast so that upon emplacement of the apparatus on an opening in the tank car a portion of the tube guide is movable into and out of the tank car, including the second end of the tube guide and the nozzle, and nozzle hose means for conveying fluid to be sprayed the spray nozzle, the nozzle hose means extendable from the spray nozzle exteriorly of the tank car, the nozzle hose means extending along and supported by the tubeguide, an air cylinder with an extendable piston secured at one end to a portion of the pedestal and at the other to the beam so that movement of the air cylinder piston articulates the spray nozzle, the spray nozzle articulable through an arc of at least about 77 degrees, cylinder hose means for conveying air under pressure to the air cylinder, the cylinder hose means extendable from the cylinder exteriorly of the tank car, the cylinder hose means extending along and supported by the tube guide, mast moving means interconnected with the mast for moving it on the bearing member, roller means are provided in the pedestal for facilitating movement therethrough of the tube guide, the tube guide contacting the roller means, and a chain disposed on the tube guide and positively drivable by a sprocket interconnected with and driven by the moving means.

21. An apparatus for cleaning an interior of a tank car, the apparatus comprising a mainframe including a mast and an arcuate hollow tube guide connected to the mast, the mast having a first end and a second end, a pedestal having a bearing member, the mast rotatably mounted on the bearing member, the pedestal emplaceable in the tank car opening, the arcuate hollow tube guide having a first end and a second end, the first end rotatably connected to the second end of the mast, moving means for moving the tube guide, the moving means mounted to the mast, the tube guide movable positively by the moving means, at one spray nozzle mounted to a beam movably mounted to the second end of the tube guide, the spray nozzle for spraying fluid under pressure on the tank car interior, the tube guide movable toward and away from the mast so that upon emplacement of the apparatus on an opening in the tank car a portion of the tube guide is movable into and out of the tank car, including the second end of the tube guide and the nozzle, and nozzle hose means for conveying fluid to be sprayed to the spray nozzle, the nozzle hose means extendable from the spray nozzle exterior of the tank car, the spray nozzle articulably connected to the second end of the tube guide, an air cylinder with an extendable piston secured to the mainframe, one end of a control cable secured to the piston and its other end secured to the beam so that movement of the piston moves the spray nozzle, the spray nozzle articulable through an arc of at least about 95 degrees, cylinder hose means for conveying air under pressure to the air cylinder, the cylinder hose means extendable from the cylinder to a source of pressurized air, mast moving means interconnected with the mast for moving it on the bearing member, roller means in the pedestal for facilitating movement therethrough of the tube guide, the tube guide contacting the roller means, a chain disposed on the tube guide and positively drivable by a sprocket interconnected with and driven by the moving means, and a major part of nozzle hose means and the control cable extending through the hollow tube guide.

* * * * *

UNITED STATES PATENT AND TRADEMARK OFFICE

CERTIFICATE OF CORRECTION

PATENT NO. : 5,095,929

DATED : March 17,1992

INVENTOR(S) : Charles D. Harvey

It is certified that error appears in the above-identified patent and that said Letters Patent is hereby corrected as shown below:

Column 8, Line 40, after "end," and before "pedestal" insert --a--.

Column 9, line 32, after "at" and before "one" insert --least--.

Signed and Sealed this

Third Day of August, 1993

*Attest:*

Michael K. Kirk

MICHAEL K. KIRK

*Attesting Officer*

*Acting Commissioner of Patents and Trademarks*